US005527048A

United States Patent [19]

Conte

[11] Patent Number: 5,527,048

[45] Date of Patent: Jun. 18, 1996

[54] BRAKING DEVICE PARTICULARLY FOR SKATES WITH ALIGNED WHEELS

[75] Inventor: Gino Conte, Caerano S. Marco, Italy

[73] Assignee: ROCES S.R.L., Montebelluna, Italy

[21] Appl. No.: 178,043

[22] Filed: Jan. 6, 1994

[30] Foreign Application Priority Data

Jan. 19, 1993 [IT] Italy ..... TV93A0005

[51] Int. Cl.[6] ..... A63C 17/14

[52] U.S. Cl. ..... 280/112; 280/11.2

[58] Field of Search ..... 280/11.2, 11.22, 280/11.23, 11.19; 185/5

[56] References Cited

U.S. PATENT DOCUMENTS

| | | | |
|---|---|---|---|
| 4,807,893 | 2/1989 | Huang | 280/11.2 |
| 5,088,748 | 2/1992 | Koselka et al. | 280/11.2 |
| 5,183,275 | 2/1993 | Hoskin | 280/11.2 |
| 5,192,099 | 3/1993 | Riutta | 280/11.22 |
| 5,257,795 | 11/1993 | Babcock | 280/11.2 |

*Primary Examiner*—Richard M. Camby
*Attorney, Agent, or Firm*—R. Neil Sudol; Henry D. Coleman

[57] ABSTRACT

A braking device, particularly for skates having a frame to which a plurality of mutually aligned wheels is pivoted. The device is constituted by an element which is pivoted to the frame in contrast with a spring and interacts with the ground at a first end upon a backward rotation of the skate. The device comprises a second end which interacts with the lateral surfaces of one of the wheels, allowing to preserve them from wear.

3 Claims, 1 Drawing Sheet

BRAKING DEVICE PARTICULARLY FOR SKATES WITH ALIGNED WHEELS

BACKGROUND OF THE INVENTION

1. Field of the invention

The present invention relates to a braking device particularly for skates with aligned wheels.

2. Description of the Prior Art

Bringing the skate to a full stop during sports practice is currently a problem for the skater; in conventional skates, a brake constituted by a block of plastic material is in fact associated to the rear of the wheel supporting frame, and said block is made to interact with the ground by rotating the skate backward.

However, this operation is hazardous, since it can cause the skater to lose his balance, with dangerous consequences. Furthermore, the block wears considerably and must be replaced very frequently.

Solutions are also known which provide form the interaction of a brake directly on the rolling surface of the wheel: the consequent drawback is of course the need replace the wheel frequently.

SUMMARY OF THE INVENTION

The aim of the present invention is to solve the described drawbacks by providing a skate which allows the skater to stop it or reduce its speed while preserving the wheel from wear and allowing the skater to perform the maneuver in safety.

A further object is to provide a skate with aligned wheels which allows the skater to achieve better braking control.

Another important object is to provide a skate which has a simple structure and is easy to industrialize.

Another object is to provide a braking device which is reliable, safe in use and has very low manufacturing costs which allow its widespread diffusion and application even to conventional skates.

This aim, these objects and others which will become apparent from the following description are achieved by a braking device as claimed in the appended claims.

BRIEF DESCRIPTION OF THE DRAWINGS

Other objects will become apparent during the following description, which must be considered together with the accompanying drawings, which illustrate, by way of non-limitative example, a particular embodiment, in which.

DESCRIPTION OF A PREFERRED EMBODIMENT OF THE INVENTION

Figure 1:
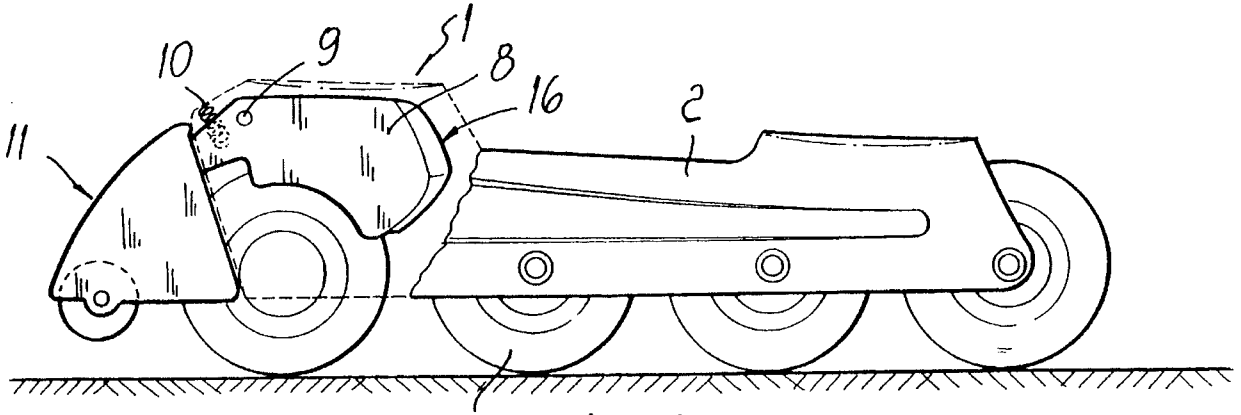
FIG. 1 is a partially sectional side view of a portion of a skate wherein the device is shown in the inactive condition.
Figure 2:
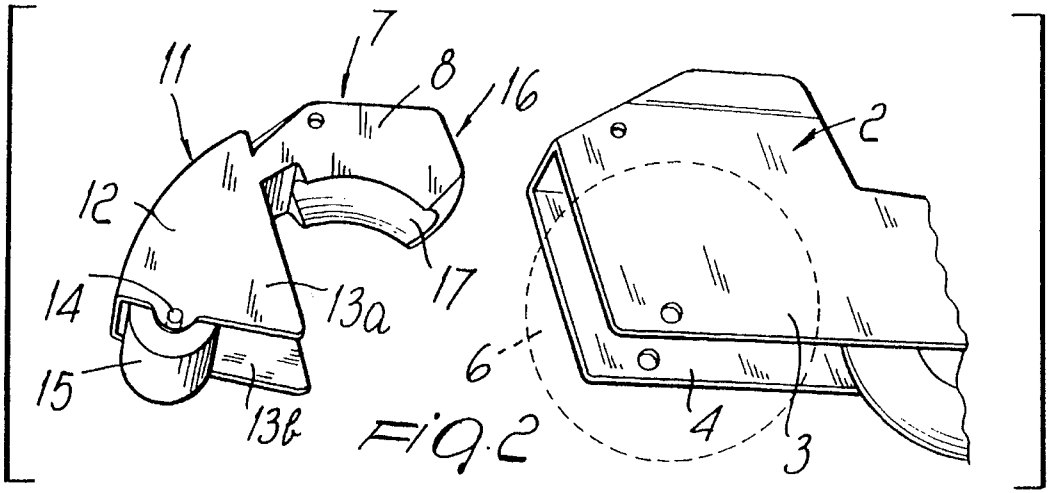
FIG. 2 is an exploded partial view of some of the components of the device.
Figure 3:
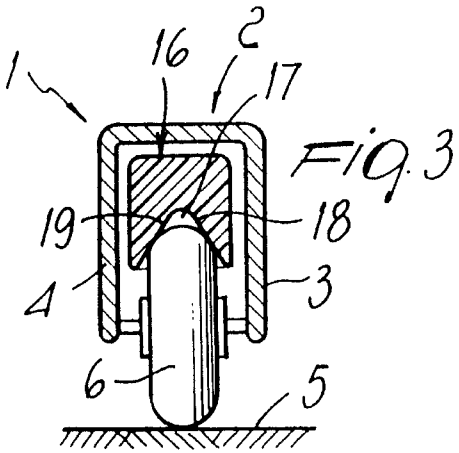
FIG. 3 is a cross section view of the device, taken at the element associated with the frame, in the braking conditions.

With reference to the above figures, and considering that they exemplify a particular embodiment and are in variable scale and that identical or equivalent parts correspond to individual reference numerals in said figures, the numeral 1 designates the braking device, particularly for skates comprising a U-shaped frame 2 with first wings 3 and 4 directed toward the ground 5; a plurality of mutually aligned wheels

6 is pivoted to the wings.

The braking device is constituted by an element 7 which is composed of a central body 8 which is associated between the first wings 3 and 4 of the frame 2 so that it can swing about a first pivot 9.

The central body 8 is partially accommodated within the frame 2 and can swing in contrast with an elastically deformable element, such as a spring 10.

The central body 8 has a first end 11, arranged outside the frame 2, which is formed by a shell 12 having the second wings 13*a* and 13*b*. A roller 15 is freely pivoted, by means of a second pivot 14, below the second wings 13*a* and 13*b* and interacts with the ground 5 upon a backward rotation imparted to the skate.

The spring 10 can be interposed, in a pre-compressed condition, between the central body 8 and the frame 2 so that the second wings 13*a* and 13*b* of the shell 12 remain in abutment against the first wings 3 and 4 of the frame 2: this allows to keeps the roller 15 raised from the ground during normal sports practice.

The central body 8 has a second end 16 which arranged inside the frame 2 and surmounts one of the wheels 6 in the condition for normal sports practice. The second end 16 also has a surface 17 which faces the wheel 6 and has a concave shape so as to form two inclined planes 18 and 19 which interact with the lateral surfaces, or with the surfaces adjacent to the rolling surface, of the underlying wheel 6 during braking.

Braking occurs upon a backward rotation of the skate, determined by the skater, which makes the roller 15 touch the ground 5.

This leads to the rotation, about the first pivot 9, of the element 7, which further compresses the spring 10 and makes the inclined planes 18 and 19 interact with the lateral surfaces of the wheel.

The spring 10 can be interposed between the frame 2 and the second end 16, so as to keep the inclined planes 18 and 19 raised with respect to the lateral surfaces or to the surfaces adjacent to the rolling surface of the underlying wheel 6 during normal sports practice.

It has thus been observed that the device has achieved the intended aim and objects, allowing the skater to stop the skate or reduce its speed, while preserving the wheel from wear, since it is the roller, which may also be made of very hard material, that interacts with the ground. Furthermore, the fact that the rotation of the element 7 makes the inclined planes interact with the lateral surfaces of the wheel also allows the shifting the center of gravity of the braking action below the foot of the skater, thus improving balance and braking control and increasing safety.

Naturally, the materials of which the elements of the device are made, as well as the dimensions of the individual components of the device, may vary according to the requirements.

I claim:

1. A roller skate comprising:

a frame having a front end and a rear end;

a plurality of mutually aligned wheels rotatably secured to said frame, said wheels including a rearmost wheel;

a braking element pivotably mounted to said frame at said rear end thereof, said braking element including a ground contact portion at a rear end and a wheel contact portion at a front end, said braking element further including a central body extending over said rearmost wheel so that said wheel contact portion is engageable with a front part of said rearmost wheel upon a pivoting of said braking element during a braking procedure; and an elastically deformable element in contact with said braking element and said frame to bias said braking element towards a position wherein said wheel contact portion is spaced from said rearmost wheel;

said wheel contact portion including at least one braking surface disposed at an inclined angle to contact a lateral surface of said rearmost wheel during said braking procedure said central body having a first end portion disposed outside of said frame and a second end portion disposed inside said frame over said rearmost wheel, said braking surface being one of a pair of at least partially opposed inclined surfaces in contact with respective lateral surfaces of said rearmost wheel during said braking procedure.

2. The skate defined in claim 1 wherein said elastically deformable element is a pre-stressed spring interposed between said second end portion of said central body and said frame so that said inclined surfaces are spaced from said lateral surfaces during normal non-braking use of the skate.

3. A roller skate comprising:

a frame having a front end and a rear end;

a plurality of mutually aligned wheels rotatably secured to said frame, said wheels including a rearmost wheel;

a braking element pivotably mounted to said frame at said rear end thereof, said braking element including a ground contact portion at a rear end and a wheel contact portion at a front end, said ground contact portion of said braking element including a roller, said braking element further including a central body extending over said rearmost wheel so that said wheel contact portion is engageable with a front part of said rearmost wheel upon a pivoting of said braking element during a braking procedure, said braking element additionally including a pair of wings at the rear end of said braking element, said wings being disposed outside of said frame, said roller being partially disposed between said wings; and an elastically deformable element in contact with said braking element and said frame, said elastically deformable element being a pre-stressed spring interposed between said central body and said frame to bias said braking element towards a position wherein said wheel contact portion is spaced from said rearmost wheel and said wings remain in abutment against said frame to maintain said roller spaced from a ground surface during normal non-braking use of the skate.

* * * * *